US005610991A

United States Patent [19]

Janse

[11] Patent Number: 5,610,991

[45] Date of Patent: Mar. 11, 1997

[54] NOISE REDUCTION SYSTEM AND DEVICE, AND A MOBILE RADIO STATION

[75] Inventor: Cornelis P. Janse, Eindhoven, Netherlands

[73] Assignee: U.S. Philips Corporation, New York, N.Y.

[21] Appl. No.: 350,357

[22] Filed: Dec. 6, 1994

[30] Foreign Application Priority Data

Dec. 6, 1993 [EP] European Pat. Off. ..... 93203421

[51] Int. Cl.[6] ..... H04R 3/00

[52] U.S. Cl. ..... 381/92; 381/94; 381/13

[58] Field of Search ..... 381/92, 94, 71, 381/72, 13; 455/89

[56] References Cited

PUBLICATIONS

R. Zelinski, "A Microphone Array With Adaptive Post–Filtering For Noise Reduction In Reverberant Rooms", 1988 International Conference on Accoustics, Speech and Signal Processing, Apr. 11–14, 1988, New York City, pp. 2578–2581.

K. Kroschel, "Enhancement Of Speech Signals Using Microphone Arrays", Digital Signal Processing, Proceedings of the International Conference, Florence, Italy, 4–6 Sep., 1991, pp. 223–228.

R. N. Bracewell, "The Fourier Transform and Its Applications", 1986, pp. 356–384.

R. E. Blauht, "Fast Algorithms for Digital Signal Processing" Addison Wesley, 1987, pp. 352–362.

P. De Souza, "A statistical Approach to the Design of an Adaptive Self–Normanlizing Silence Detector", IEEE Trans. on Acoustics, Speech and Signal Proceesing, vol. ASSP–31, No. 3, Jun. 1983, pp. 678–684.

*Primary Examiner*—Curtis Kuntz
*Assistant Examiner*—Minsun Oh
*Attorney, Agent, or Firm*—Jack D. Slobod

[57] ABSTRACT

A noise reduction system and device, and a mobile radio station. Known is a combined Zelinski-spectral subtraction system (1) for noise reduction in a combined speech signal (a(t)) in which signals are recorded with a plurality of microphones (5, 6, 7), using a Wiener filter (10) for estimation of the combined speech signal (a(t)'). In the known system (1) sums and differences of all combinations of speech signals are formed, it being assumed that the differences comprise noise only. Furthermore, a two stage estimation process is carried out, giving rise to considerable estimation errors. An alternative combined Zelinski-spectral subtraction system (1) is proposed, giving rise to fewer estimation errors and being more efficient from a computational point of view. In the Zelinski system, spectral subtraction is carried out on a combined cross spectrum ($\Phi_{cc}$). Then, on a speech segment by speech segment basis, filter coeffients for the Wiener filter (10) are determined from a combined auto power spectrum ($\Phi_{ac}$) and the thus corrected combined cross power spectrum ($\Phi_{cc}'$). The spectral subtraction is carried out on a lower part of the frequency range only, thereby not introducing unneccesary artefacts.

7 Claims, 3 Drawing Sheets

NOISE REDUCTION SYSTEM AND DEVICE, AND A MOBILE RADIO STATION

Figure 1:
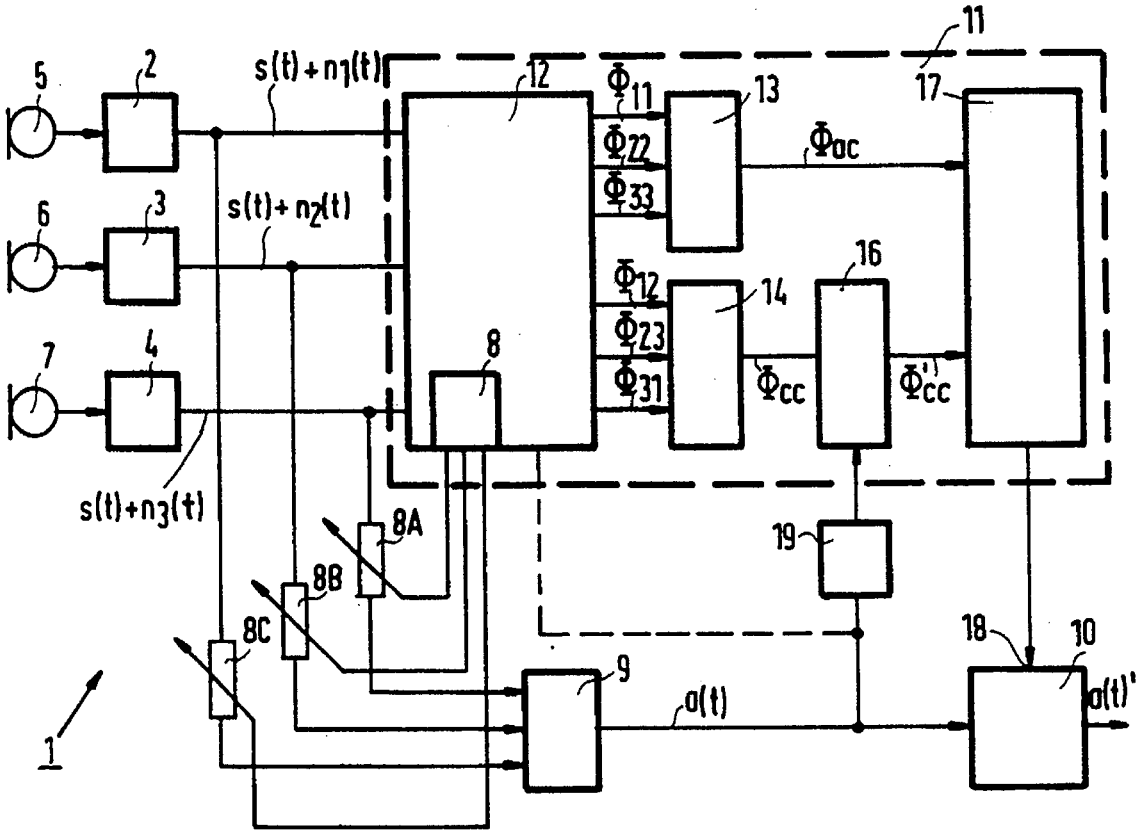

The present invention relates to a noise reduction system for reducing noise in a combined speech signal, comprising sampling means for sampling a plurality of speech signals disturbed by additive noise, in particular recorded by respective microphones being spaced apart from each other, the system further comprising an adaptive filter of which an input is coupled to adding means for adding the speech signals, and of which an output provides a noise corrected combined speech signal, and the system further comprising signal processing means being arranged for determining combined auto and cross power spectra from auto and cross power spectra determined from transformed samples of the speech signals, and being arranged for providing coefficients, which are derived from the combined auto and cross power spectra on a speech signal segment basis, to coefficient inputs of the filter.

The present invention further relates to a noise reduction device and to a mobile radio station comprising such a device.

A noise reduction system of this kind is known from an article "A microphone array with adaptive post-filtering for noise reduction in reverberant rooms", R. Zelinski, ICASS 88, International Conference on Acoustics, Speech, and Signal Processing, Apr. 11–14, 1988, N.Y., pp. 2578–2581, IEEE. The known article discloses a speech communication system in which noise in a combined speech signal is reduced. First, speech signals recorded with four microphones are phase aligned in the time domain for eliminating differences in path lengths, and then supplied to an adaptive Wiener filter as a combined signal. With speech segments of 16 msec, filter coefficients of the Wiener filter are updated, a Wiener filter being optimum in signal estimation for stationary processes and speech at most being stationary for 20 msec. The filter coefficients of the Wiener filter are determined by subjecting samples of the noisy speech signals to a discrete Fourier transform, by calculating combined auto and cross power spectra from the Fourier transformed samples, by inverse Fourier transforming the combined spectra, and by combining auto and cross correlations. With the known signal-to-noise improvement method substantially only uncorrelated noise is suppressed. It is assumed that noise in the respective recorded speech signals is uncorrelated. Such a condition is not true, for instance, in systems where the microphones are spaced at relatively close distances, such as with handsfree telephony in cars. For a spacing of 15 cm it has been found that the Zelinski-method does not give satisfactory results for noise frequencies below 800 Hz, the noise sources then being correlated. In cars there are various noise sources, e.g. the four tires give rise to four broad spectrum uncorrelated noise sources, the exhaust pipe gives rise to an noise source with a bandwidth of a few kHz, and motor noise gives rise to dominant noise peaks at 200–300 Hz.

A further noise reduction system is known from an article "Enhancement of speech signals using microphone arrays", K. Kroschel, Proceedings of the International Digital Signal Processing Conference Florence, Italy, 4–6 Sep. 1991, pp. 223–228, Elsevier Science Publishers B. V., 1991. This known article discloses a noise reduction system in which the so-called Zelinski method is combined with a so-called spectral subtraction method for obtaining noise reduction in a combined speech signal obtained from an array of microphones in a noisy environment. Before combining the speech signals, the recorded speech signals are sampled, Fourier transformed, and phase aligned in the Fourier domain. For all combinations of delay compensated signals, sums and differences are formed in the frequency domain. The reasoning is then, that with a correct phase alignment, the sums contain the enhanced speech signal and the differences the equivalent noise signal. Starting from this assumption, in a two stage spectral subtraction method, using the sums and differences, speech is enhanced in eliminating the noise. In cars, or more generally in relatively small rooms, where signals can be easily reflected, the assumption that the differences only comprise noise does not hold, thus giving rise to far less improvement than theoretically predictable. Also, because of the fact that for all signal pairs sums and differences are formed, the method is not very efficient from a computational point of view, i.e requires a lot of arithmetic operations. Furthermore, the application of a two stage method, implying extra estimation steps, introduces extra estimation errors, thereby deteriorating the overall speech enhancement process. Also, the Kroschel system introduces an overall delay of the speech signal, corresponding to the segment size of the Fourier transform. Such an overall delay is very disadvantageous, for instance, in car telephony systems.

It is an object of the present invention to provide a noise reduction system combining the so-called Zelinski system with spectral subtraction, not having said disadvantages of the Zelinski method, and not having the drawbacks of the known combined Zelinski-spectral subtraction system.

To this end a noise reduction system according to the present invention is characterized in that the signal processing means is further arranged for determining the combined cross spectrum during speech segments and speech pause segments, that the system is arranged for determining an estimate of the combined cross power spectrum for speech pause segments, and that the signal processing means is further arranged for determining a corrected combined cross power spectrum by subtracting the estimate from the combined cross power spectrum determined during the speech segment. Because of the fact that the spectral subtraction method is applied to only a single variable in the frequency domain, namely the combined cross power spectrum, and thus fewer estimation errors are made, the system according to the present invention gives a better overall estimation of the speech signal. Also, the signal processing means will have to carry out fewer operations. Thus, a less expensive digital signal processor can be applied, when the signal processing means is implemented by means of such a digital signal processor. Furthermore, in the Zelinski part of the system uncorrelated noise signals are already cancelled out. Thus, the estimate of the combined cross power spectrum is more accurate, resulting in a better overall estimation of the speech signal.

In a preferred embodiment of the noise reduction system according to the present invention the combined cross power spectrum for speech pause segments is estimated as a weighted average from a previously determined combined cross power spectrum for speech pauses and a current combined cross power spectrum. Herewith, the combined cross power spectrum during speech pause segments is estimated implicitely, rendering explicit speech pause detection means superfluous. Thus a very simple system is achieved.

Another embodiment of the noise reduction system according to the present invention comprises speech pause detection means which provides a speech pause detection signal to the signal processing means, which determines the combined cross power spectrum accordingly. Herewith, the estimations for the combined cross power spectra during speech segments and speech pause segments can be carried out separately. Thus, a better overall estimation of the speech signal is obtained.

Figure 2:
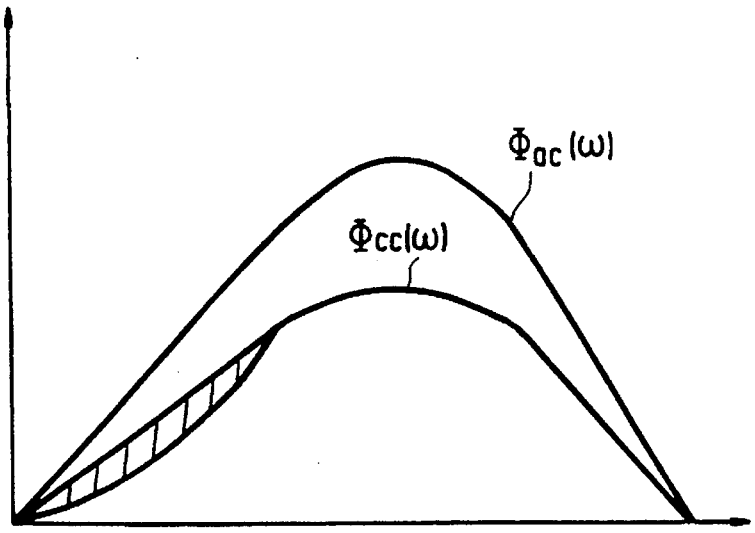
Figure 3:
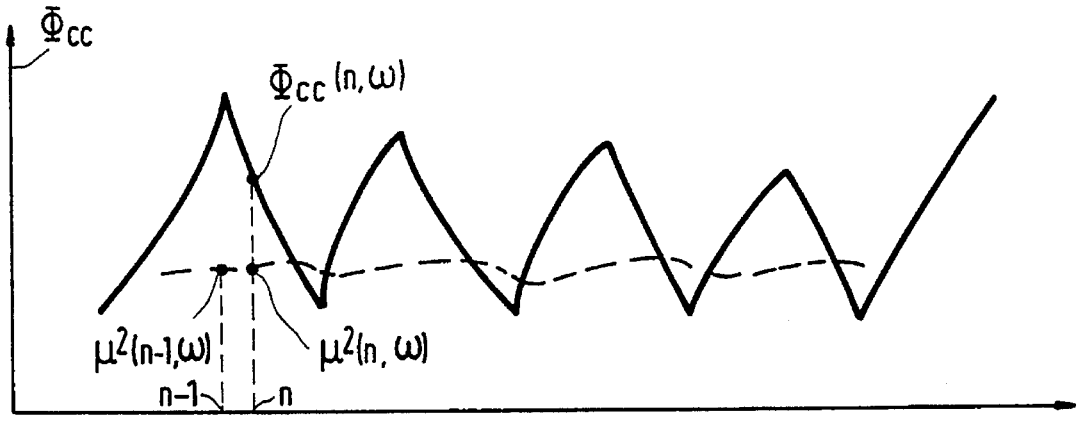
Figure 4:
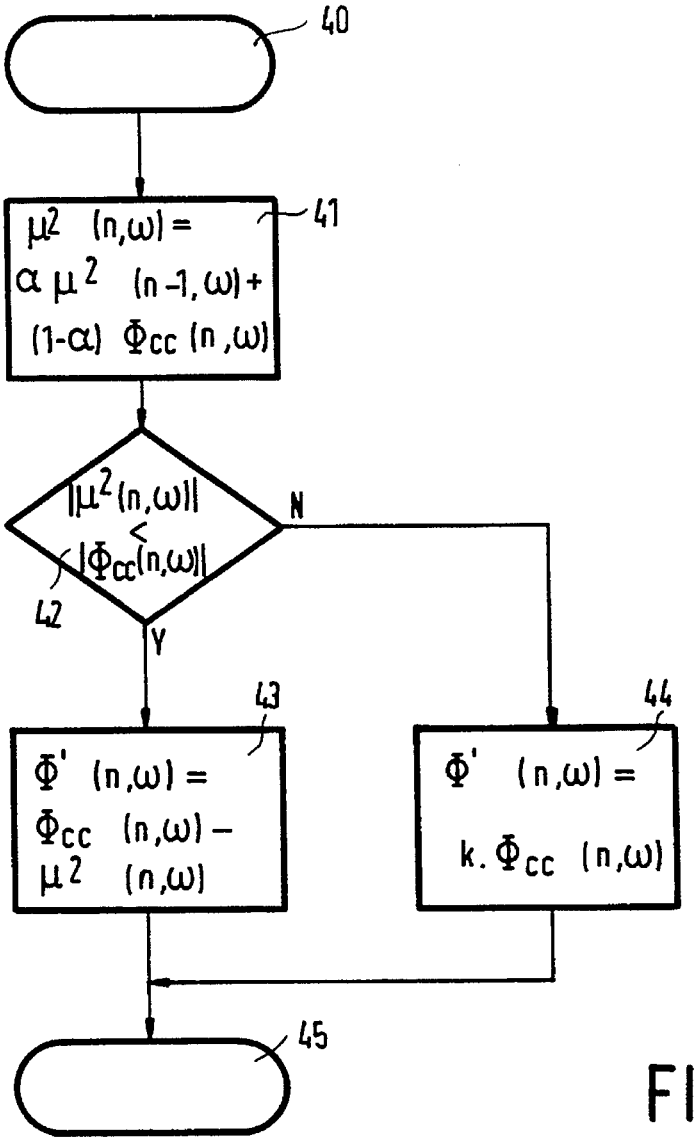
Figure 5:
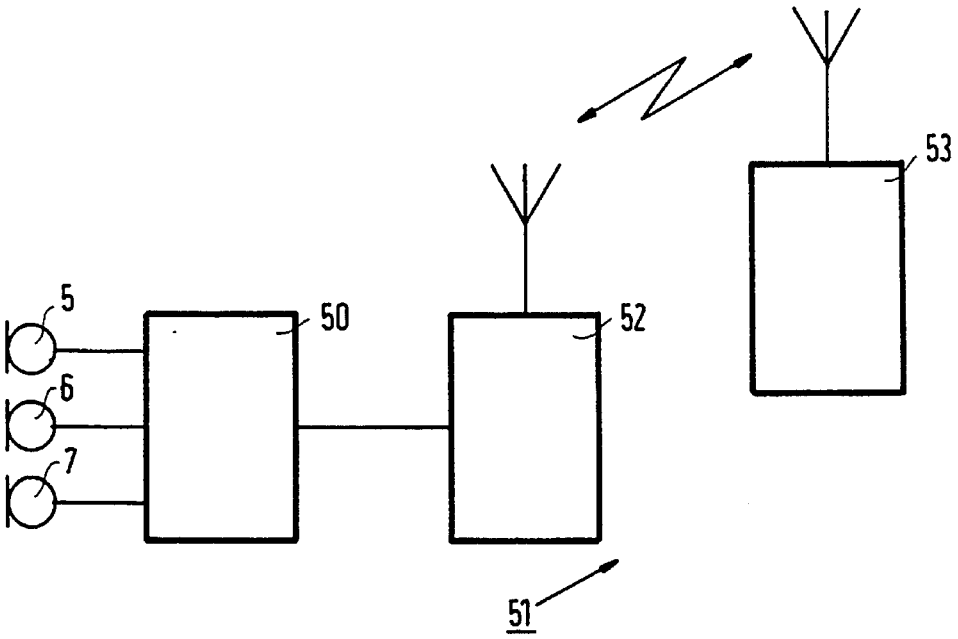
Figure 6:
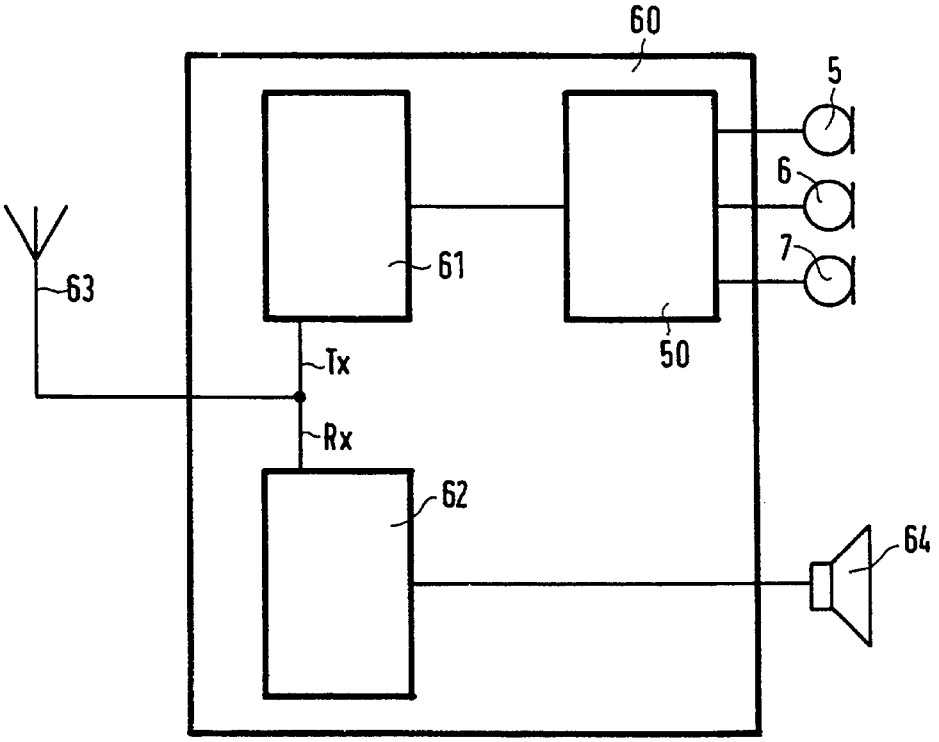

The present invention will now be described, by way of example, with reference to the accompanying drawings, wherein FIG. 1 shows a noise reduction system according to the present invention, FIG. 2 shows an influence of correlated noise in a combined speech signal on a combined cross power spectrum, FIG. 3 shows a combined cross power function for a single frequency with estimation of a noise component therein, FIG. 4 shows a flowchart for estimating a corrected combined cross power value according to the present invention, FIG. 5 shows a noise reduction device in a mobile telephony system, and FIG. 6 shows a mobile radio station for use in a mobile radio system.

Throughout the figures the same reference numerals are used for the same features.

FIG. 1 shows a noise reduction system 1 for reducing noise in a combined speech signal a(t). The system comprises sampling means in the form of A/D-converters 2, 3, and 4 for respective sampling of speech signals recorded with microphones 5, 6, and 7. Such speech signals may speech signals to be supplied to a handsfree telephone in a car. Handsfree telephony in a car is a desirable feature, since traffic safety is involved. With handsfree telephony the loudspeaker and the microphones are placed at fixed locations in the car. As compared with conventional telephony the distance between the microphones and the speakers' mouth is enlarged. As a result the signal-to-noise ratio decreases, and the need for noise reduction becomes obvious. In the car various noise sources are present, noise sources at dominant frequencies, and noise sources with a more spreaded spectrum. Due to the fact that in a car the microphones are spaced close together, the overall noise spectrum exhibits correlated noise at lower frequencies, e.g. below 800 Hz, and uncorrelated noise at higher frequencies. The present invention is applicable to such a car telephony system, and system with similar noise characteristics. The sampled speech signals are supplied to signal alignment control means 8 for phase aligning the speech signals. Such alignment, known per se, can be carrier out either in the time domain or in the frequency domain. Said Kroschel article discloses alignment in the frequency domain. For an optimal operation of the present invention an alignment to half a sample is required. Respective sampled signals $s(t)+n_1(t)$, $s(t)+n_2(t)$, and $s(t)+n_3(t)$ are supplied to adding means 9, after having been phase aligned with respective phase alignment means 8A, 8B, and 8C, so as to form the combined speech signal a(t). The phase alignment means 8A, 8B, and 8C can be tapped delay lines (not shown), of which taps are fed to a multiplexer (not shown), the multiplexer being controlled by the phase alignment control means 8. The combined speech signal a(t) is supplied to an adaptive Wiener filter 10, such a filter being known per se. At an output of the Wiener filter 10, a noise corrected version a(t)' of the combined speech signal a(t) is available. The sampled signals are also supplied to signal processing means 11, which can be a digital signal processor with non-volatile memory for storing a program implementing the present invention, and with volatile memory for storing program variables during execution of the program. Digital signal processors with non-volatile and volatile memory are known per se. The signal processing means 11 comprise discrete Fourier transform means for Fourier transforming the sampled and phase corrected speech signals, such discrete Fourier transform means being known per se, e.g. from the handbook "The Fourier Transform and Its Applications", R. N. Bracewell, McGraw-Hill, 1986, pp. 356–362, pp. 370–377. The signal processing means 11 are further arranged for determining auto and cross power spectra from the Fourier transformed sampled and phase corrected signals, in the given example with three speech signals, respective auto power spectra $\Phi_{11}$, $\Phi_{22}$, and $\Phi_{33}$, and respective cross power spectra $\Phi_{12}$, $\Phi_{23}$, and $\Phi_{31}$. Pages 381–384 of said handbook of Bracewell discloses such forming of spectra from Fourier transforms, it being well-known that a power spectrum is obtained by multiplying a Fourier transform with a conjugate Fourier transform. A power spectrum is applied when it is unimportant to know the phase or when the phase is unknowable. The power spectra are determined for segments of speech, e.g. with 10 kHz sampling and 128 samples within a segment, segments of 12, 8 msec, for segments it being a reasonable assumption that speech is stationary. In this respect, the Wiener filter 10 is optimal for signal estimation of stationary processes. The Fourier, phase alignment, and auto and cross correlation operations are carried out in a processing block 12, whereby each power spectrum is stored in DSP (Digital Signal Processor) storage means (not shown in detail), in the form of a one dimensional frequency array of point, each point representing a frequency. The phase alignment control means 8 form part of the processing block 12. In the example given, with 128 samples per signal segment padded with 128 zero samples, the arrays comprise 128 frequency points, spanning a frequency range of 4 kHz. The auto power spectra $\Phi_{11}$, $\Phi_{22}$, and $\Phi_{33}$ are supplied to first adding means 13 so as to form a combined auto power spectrum $\Phi_{ac}$, and the cross power spectra $\Phi_{12}$, $\Phi_{23}$, and $\Phi_{31}$ are supplied to second summing means 14 so as to form a combined cross power spectrum $\Phi_{cc}$. According to the present invention, the combined cross power spectrum $\Phi_{cc}$ is supplied to spectral subtraction means 16 so as to form a corrected combined cross power spectrum $\Phi_{cc}'$, to be described in detail in the sequel. As in the Zelinski method, the processing means 11 comprise filter coefficient determining means 17 for determining coeffients, to be supplied with each speech segment or speech pause segment to coefficient inputs 18 of the Wiener filter 10. Such filter coefficient determining means 17 can be Inverse Discrete Fourier Transform means for determining time domain combined auto correlation and cross correlation functions followed by a so-called Levinson recursion method for providing the coefficients, the Levinson recursion being known per se, e.g. from the handbook "Fast Algorithms for Digital Signal Processing", R. E. Blahut, Addison Wesley, 1987, pp. 352–362, or can be a division of the combined auto power spectrum $\Phi_{ac}$ and the corrected combined cross spectrum $\Phi_{cc}'$ in the frequency domain, followed by an Inverse Discrete Fourier transform for providing the coefficients. Herewith, stored phase information during Fourier transform is taken into account. Because of the fact that the spectral subtraction as according to the present invention is mainly operative in the lower frequency range, say below 800 Hz, spectral subtraction computations are carried out only for a limited number of data points in the cross power spectra arrays (not shown in detail), i.e. in the given example for the first 24 data points in the 128 data point array. Thus, the present invention provides a very simple implementation of a combined Zelinski-spectral subtraction system. In a first embodiment of the present invention, the spectral subtraction is carried out on the basis of an implicit estimate for noise from the combined cross power spectrum. In a second embodiment of the present invention, speech pause detection means 19 provide a control signal ctl to the spectral subtraction means 16 for controlling storing of the correlated noise component during speech pause segments and for controlling the spectral subtraction on the basis of the stored noise component. Such speech pause detection means 19 is known per se, e.g. from a survey article, "A Statistical Approach to the Design of an Adaptive Self-Normalizing Silence Detector", P. de Souza, IEEE Transactions on ASSP, Vol. ASSP-31, June 1983, pp. 678–684. The present invention is based upon the insight that uncorrelated noise cancels out when determining the combined cross power spectrum, whereas correlated noise does not. Thus, by determining the correlated noise and by applying spectral subtraction, the correlated noise is cancelled too. With the present invention, an improvement of 6–7 dB over Zelinski is achieved.

FIG. 2 shows an influence of correlated noise in the combined speech signal a(t) on the combined cross power spectrum $\Phi_{cc}$, so as to illustrate the speech signal estimation improvement obtained. Shown are the combined auto power spectrum $\Phi_{ac}(\omega)$ and the combined cross power spectrum $\Phi_{cc}(\omega)$, as a function of the frequency $\omega$. The combined auto power spectrum $\Phi_{ac}$ is equal to $|S(\omega)|^2+|N_c(\omega)|^2+|N_r(\omega)|^2$, the indices 'c' and 'r' indicating power spectra of correlated and uncorrelated noise, respectively, it being assumed that the speech and the correlated noise is phase aligned. Then, with Zelinski, the combined cross power spectrum $\Phi_{cc}$ will be equal to $|S(\omega)|^2+|N_c(\omega)|^2$. The influence of $|N_c(\omega)|^2$ is shown by the shaded area. When expressed in dB, the difference between the two curves gives the attenuation that can be obtained with the Wiener filter 10, since the Wiener filter can be expressed as the quotient of $\Phi_{cc}(\omega)$ and $\Phi_{ac}(\omega)$. What is thus needed is an estimate of $|S(\omega)|^2$ in the numerator thereof. To achieve this estimate, spectral subtraction is applied. For instance, in the implicit embodiment, the bias $\mu^2(\omega)$ of $|N_c(\omega)|^2$ of can be estimated during non-speech activity and be subtracted from the combined cross power spectrum, giving the required estimate for the numerator. Since the correlated noise is only present at low frequencies, correction is only carried out in that region. For getting a good compromise between attenuation and artefacts introduced by attenuation, smoothing or weighting is applied for getting an estimate for $\mu^2(\omega)$.

FIG. 3 shows the combined cross power function $\Phi_{cc}$ for a single frequency $\omega$ with smooth estimation of the noise component $\mu^2$ therein, wherein an integer 'n' is an index of the speech segment. The smooth estimation is indicated with a dashed line. It holds that $\mu^2(n,\omega)=\alpha\cdot\mu^2(n-1,\omega)+(1-\alpha)\cdot\Phi_{cc}(n,\omega)$ if $\mu^2(n,\omega)<\Phi_{cc}(n,\omega)$ then the corrected combined cross spectrum point $\Phi_{cc}'(n,\omega)=\Phi_{cc}(n,\omega)-\mu^2(n,\omega)$, else $\Phi_{cc}'(n,\omega)=k\cdot\Phi_{cc}(n,\omega)$, k being a real value in the interval [0, 1]. I.e., the original combined cross power spectrum is restored when $\Phi_{cc}(\omega)-\mu^2(\omega)$ is negative. The parameter $\alpha$ is a weighting factor, e.g. $\alpha=0.95$. A large value of $\alpha$ means that previous estimates are weighted more heavily. Only the real part of $\Phi_{cc}$ is taken in consideration. When speech and noise are properly aligned, the imaginary part of $\Phi_{cc}$ contains estimation errors. Then, the speech estimation can further be improved by zeroing the imaginary part. If the combined speech signal a(t) comprises alignment errors, zeroing the imaginary part would give rise to unwanted speech attenuation, especially for higher frequencies, audible as dull sounding higher frequencies. Then, the imaginary part should not be zeroed. Because the Wiener filter 10 then only gives a phase shift, the spectral subtraction is carried out on both the real and imaginary part of $\Phi_{cc}$. In the latter case, in the test, absolute values are token. In an implementation, 3 microphones where applied, spaced at 15 cm apart from each other. A sample frequency of 8 kHz was chosen, with speech segments of 128 consecutive microphone samples, padded with 128 zeroes. The spectral subtraction was carried out on both the real and imaginary part of $\Phi_{cc}$, in a frequency band of 0–600 Hz. The weighting factor $\alpha$ was chosen 0.9, and a Wiener filter 10 consisting of 33 coefficients was applied.

FIG. 4 shows a flowchart for estimating the correct combined cross power value $\Phi_{cc}'(n,\omega)$ according to the present invention. Block 40 is an entry block, block 41 is an update block for $\mu^2(n,\omega)$, block 42 is a test block, block 43 is a processing block if the test is true, block 44 is a processing block if the test is false, and block 45 is a quit block. The process is repeated for the relevant frequency points, for the real part and the imaginary part of $\Phi_{cc}$.

FIG. 5 shows a noise reduction device 50 according to the present invention, comprising all the features as described, in a mobile telephony system 51, comprising at least one mobile radio station 52, known per se, and at least one radio base station 53. Such a system can be a well-known GSM system (Global System for Mobile Communications). In the example given, the noise reduction device 50 is a separate device of which an output provides enhanced speech to a microphone input of the mobile radio station 52.

FIG. 6 shows a mobile radio station 60 for use in the mobile radio system 51. In the example given, the noise reduction device 50 is integrated within the mobile radio station 60, which can be a car telephone. An output of the noise reduction device 50 is coupled to a microphone input of a transmitter part 61 of the mobile radio station 60, which further comprises a receiver part 62. Radio frequency transmit and receive signals Tx and Rx exchanged with the base station 53 via an antenna 63, in duplex transmission mode. The mobile radio system can be a GSM car telephone, in which the present invention is implemented. In handsfree mode, received signals are supplied to a loudspeaker 64.

I claim:

1. A noise reduction system (1) for reducing noise in a combined speech signal (a(t)), comprising:

sampling means (2, 3, 4) for sampling a plurality of speech signals disturbed by additive noise ($n_1(t)$, $n_2(t)$, $n_3(t)$), recorded by respective microphones (5, 6, 7) being spaced apart from each other;

an adaptive filter (10) of which an input is coupled to adding means (9) for adding the speech signals, and of which an output provides a noise corrected combined speech signal (a(t)'); and signal processing means (11) determining combined auto and cross power spectra ($\Phi_{ac}$, $\Phi_{cc}$) from auto and cross power spectra ($\Phi_{11}$, $\Phi_{22}$, $\Phi_{33}$; $\Phi_{12}$, $\Phi_{23}$, $\Phi_{31}$) determined from transformed samples of the speech signals ($s(t)+n_1(t)$, $s(t)+n_2(t)$, $s(t)+n_3(t)$), and being arranged for providing coefficients, which are derived from the combined auto and cross power spectra on a speech signal segment basis, to coefficient inputs (18) of the filter (10), said signal processing means (11) determining the combined cross power spectrum ($\Phi_{cc}$) during speech segments and speech pause segments, said system comprising storage means for determining an estimate of the combined cross power spectrum ($\Phi_{cc}$) for speech pause segments, and said signal processing means (11) further determining a corrected combined cross power spectrum ($\Phi_{cc}'$) by subtracting the stored estimate from the combined cross power spectrum ($\Phi_{cc}$) determined during the speech segment.

2. A noise reduction system as claimed in claim 1, wherein the adaptive filter (10) is a Wiener filter.

3. A noise reduction system (1) as claimed in claim 1, wherein the combined cross power spectrum ($\mu^2(n,\omega)$) for speech pause segments is estimated as a weighted ($\alpha$) average from a previously determined combined cross power spectrum ($\mu^2(n-1,\omega)$) for speech pauses and a current combined cross power spectrum ($\Phi_{cc}(n,\omega)$).

4. A noise reduction system (1) as claimed in claim 1, comprising speech pause detection means (19) which provides a speech pause detection signal (ctl) to the signal processing means (11), which determines the combined cross power spectrum accordingly.

5. A noise reduction device comprising:

noise reduction means for reducing noise in a combined speech signal (a(t)), said noise reduction means comprising:

sampling means (2, 3, 4) for sampling a plurality of speech signals disturbed by additive noise ($n_1(t)$, $n_2(t)$, $n_3(t)$), in particular recorded by respective microphones (5, 6, 7) being spaced apart from each other;

an adaptive filter (10) having an input coupled to adding means (9) for adding the speech signals, and having an output which provides a noise corrected combined speech signal (a(t)'); and signal processing means (11) for determining combined auto and cross power spectra ($\Phi_{ac}$, $\Phi_{cc}$) from auto and cross power spectra ($\Phi_{11}$, $\Phi_{22}$, $\Phi_{33}$; $\Phi^{12}$, $\Phi_{23}$, $\Phi_{31}$) determined from Fourier transformed samples of the speech signals ($s(t)+n_1(t)$, $s(t)+n_2(t)$, $s(t)+n_3(t)$), and for providing coefficients, which are derived from the combined auto and cross power spectra on a speech signal segment basis, to coefficient inputs (18) of the filter (10), said signal processing means (11) further determining the combined cross power spectrum ($\Phi_{cc}$) during speech segments and speech pause segments, said noise reduction means comprising storage means for storing an estimate of the combined cross power spectrum ($\Phi_{cc}$) for speech pause segments, and said signal processing means (11) is further determining a corrected combined cross power spectrum ($\Phi_{cc}'$) by subtracting the stored estimate from the combined cross power spectrum ($\Phi_{cc}$) determined during the speech segment.

6. Mobile radio station comprising:

noise reduction means for reducing noise in a combined speech signal (a(t)), said noise reduction means comprising:

sampling means (2, 3, 4) for sampling a plurality of speech signals disturbed by additive noise ($n_1(t)$, $n_2(t)$, $n_3(t)$), recorded by respective microphones (5, 6, 7) being spaced apart from each other;

an adaptive filter (10) of which an input is coupled to adding means (9) for adding the speech signals, and of which an output provides a noise corrected combined speech signal (a(t)'); and signal processing means (11) for determining combined auto and cross power spectra ($\Phi_{ac}$, $\Phi_{cc}$) from auto and cross power spectra ($\Phi_{11}$, $\Phi_{22}$, $\Phi_{33}$; $\Phi^{12}$, $\Phi_{23}$, $\Phi_{31}$) determined from transformed samples of the speech signals ($s(t)+n_1(t)$, $s(t)+n_2(t)$, $s(t)+n_3(t)$), and for providing coefficients, which are derived from the combined auto and cross power spectra on a speech signal segment basis, to coefficient inputs (18) of the filter (10), said signal processing means (11) further determining the combined cross power spectrum ($\Phi_{cc}$) during speech segments and speech pause segments, and said noise reduction means determining an estimate of the combined cross power spectrum ($\Phi_{cc}$) for speech pause segments, and said signal processing means (11) further determining a corrected combined cross power spectrum ($\Phi_{cc}'$) by subtracting the estimate from the combined cross power spectrum ($\Phi_{cc}$) determined during the speech segment.

7. A noise reduction system (1) as claimed in claim 2, wherein the combined cross power spectrum ($\mu^2(n,\omega)$) for speech pause segments is estimated as a weighted ($\alpha$) average from a previously determined combined cross power spectrum ($\mu^2(n-1,\omega)$) for speech pauses and a current combined cross power spectrum ($\Phi_{cc}(n,\omega)$).

* * * * *